US006453564B1

(12) United States Patent
Foley

(10) Patent No.: US 6,453,564 B1
(45) Date of Patent: Sep. 24, 2002

(54) MULTI-FUNCTION RESCUE TOOL

(76) Inventor: Merrill R. Foley, 2235 Keiper Rd., Quakertown, PA (US) 18951

( * ) Notice: Subject to any disclaimer, the term of this patent is extended or adjusted under 35 U.S.C. 154(b) by 0 days.

(21) Appl. No.: 09/706,881

(22) Filed: Nov. 6, 2000

(51) Int. Cl.[7] ..... B26F 1/00; B25F 1/00

(52) U.S. Cl. ..... 30/359; 30/157; 30/367; 7/148; 7/158; 7/165

(58) Field of Search ..... 7/100, 143–144, 7/148–149, 158, 160–161, 165, 167–170; 30/359, 156–157, 358, 366, 367; 81/437–439

(56) References Cited

U.S. PATENT DOCUMENTS

| | | | | | |
|---|---|---|---|---|---|
| 306,413 | A | * | 10/1884 | McArdle | |
| 2,980,996 | A | * | 4/1961 | Beran | 7/118 X |
| 4,062,117 | A | | 12/1977 | Coleman | 30/317 |
| 4,268,927 | A | * | 5/1981 | Bridwell | 7/143 |
| 4,769,912 | A | | 9/1988 | Davis | 30/162 |
| 4,848,197 | A | * | 7/1989 | Kikel | 81/440 |
| 4,985,954 | A | * | 1/1991 | Wehr | 7/144 |
| 5,097,599 | A | | 3/1992 | Hawegawa | 30/359 |
| 5,513,405 | A | * | 5/1996 | Bradbury, Jr. et al. | 7/158 |
| 5,542,139 | A | * | 8/1996 | Boivin | 7/100 X |
| 5,630,242 | A | | 5/1997 | Oginaezawa | 7/144 |
| 5,653,031 | A | | 8/1997 | Richter | 30/294 |
| 5,657,543 | A | | 8/1997 | Collins | 30/367 |
| 5,845,404 | A | | 12/1998 | Jeffcoat | 30/125 |
| 6,079,071 | A | * | 6/2000 | Sablan et al. | 7/144 |

* cited by examiner

*Primary Examiner*—D. S. Meislin
(74) *Attorney, Agent, or Firm*—LaMorte & Associates, P.C.

(57) ABSTRACT

A rescue tool for use by emergency rescue personnel is claimed. The rescue tool contains a handle body having a first end and a second end. A serrated blade is pivotally coupled to the handle body. The handle body also receives and retains a spring-loaded center punch. The center punch is used to fracture the glass in the window of an automobile, while the saw blade is used to cut any plastic laminates that bind the fragments of glass together. The rescue tool also contains a hooked blade that can be used to cut a seat belt and a valve stem valve remover for flattening the tires of an automobile.

8 Claims, 2 Drawing Sheets

MULTI-FUNCTION RESCUE TOOL

BACKGROUND OF THE INVENTION

1. Field of the Invention

In general, the present invention relates to rescue tools commonly used by policemen, firemen and ambulance squads at the seen of automobile accidents. More particularly, the present invention relates to assemblies that combine multiple rescue tools within a single hand-held unit.

2. Description of the Prior Art

Policemen, firemen, ambulance squads and other rescue personnel use many different tools in performing their duties. Many of these tools are used for rescuing people from wrecked automobiles after an automobile accident. Among the tools that are commonly used are punches, saw blades and seat belt cutters. Punches are commonly used to fracture the safety glass of an automobile window, whose doors have become disabled by an accident. Saw blades are used to cut through the plastic lining of the fractured safety glass so that the safety glass can be removed. Lastly, seat belt cutters are then used to rapidly remove the seat belt from a person trapped within the automobile.

In an emergency situation, a rescuer does not have time to return to a tool box each and time they need a different rescue tool. Rather, a rescuer must have the proper tool at hand the moment that tool is needed. It is for this reason that multiple function rescue tools have been designed. Multiple function rescue tools combine various different rescue tools into a single assembly so that one tool is all that is needed during a particular type of rescue endeavor.

U.S. Pat. No. 4,062,117 to Colemen, entitled Rescue Tool Means, and U.S. Pat. No. 5,630,242 to Oginaezawa, entitled Seat Belt Cutter, both show rescue tools that contain a hammer for breaking an automobile's window and a blade for cutting a seat belt.

U.S. Pat. No. 5,097,599 to Hasegawa, entitled Emergency Escape Tool, shows a combination rescue tool that has a punch for breaking an automobile's window and shears for cutting the seat belt.

U.S. Pat. No. 5,657,543 to Collins, entitled Emergency tool, shows a combination rescue tool that contains a punch for breaking an automobile's window and a saw blade for cutting through the safety glass of the broken window.

Although the above-cited prior art patents combine some of the tools commonly needed during a rescue, none of the tools contains all of the tools that may be needed during a rescue. As such, even if a rescuer does have such a prior art device, the prior art device by itself may be insufficient to complete the rescue.

Furthermore, the prior art combination tools are expensive. Such prior art combination tools do not use standardized parts. As such, if a blade needs replacing or a punch needs replacing, only customized replacement parts can be used. This elevates the maintenance cost for such tools.

A need therefore exists for a more complete rescue tool that is more capable and versatile than those currently available. A need also exists for a complete rescue tool that uses inexpensive standardized replacement parts. These needs are met by the present invention as described and claimed below.

SUMMARY OF THE INVENTION

The present invention is a rescue tool for use by emergency rescue personnel. The rescue tool contains a handle body having a first end and a second end. A serrated blade is pivotally coupled to the handle body. The handle body also receives and retains a spring-loaded center punch. The center punch is used to fracture the glass in the window of an automobile, while the saw blade is used to cut any plastic laminates that bind the fragments of glass together. The rescue tool also contains a hooked blade that can be used to cut a seat belt and a valve stem valve remover for flattening the tires of an automobile.

The spring loaded center punch, hooked blade and saw blade are not integrally formed as part of the overall rescue tool. Rather, each of these wear components are separate, commercially available products that are received and joined together by the handle body. As such, as a particular part wears and needs replacement, it can be done so at low cost and with little labor.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
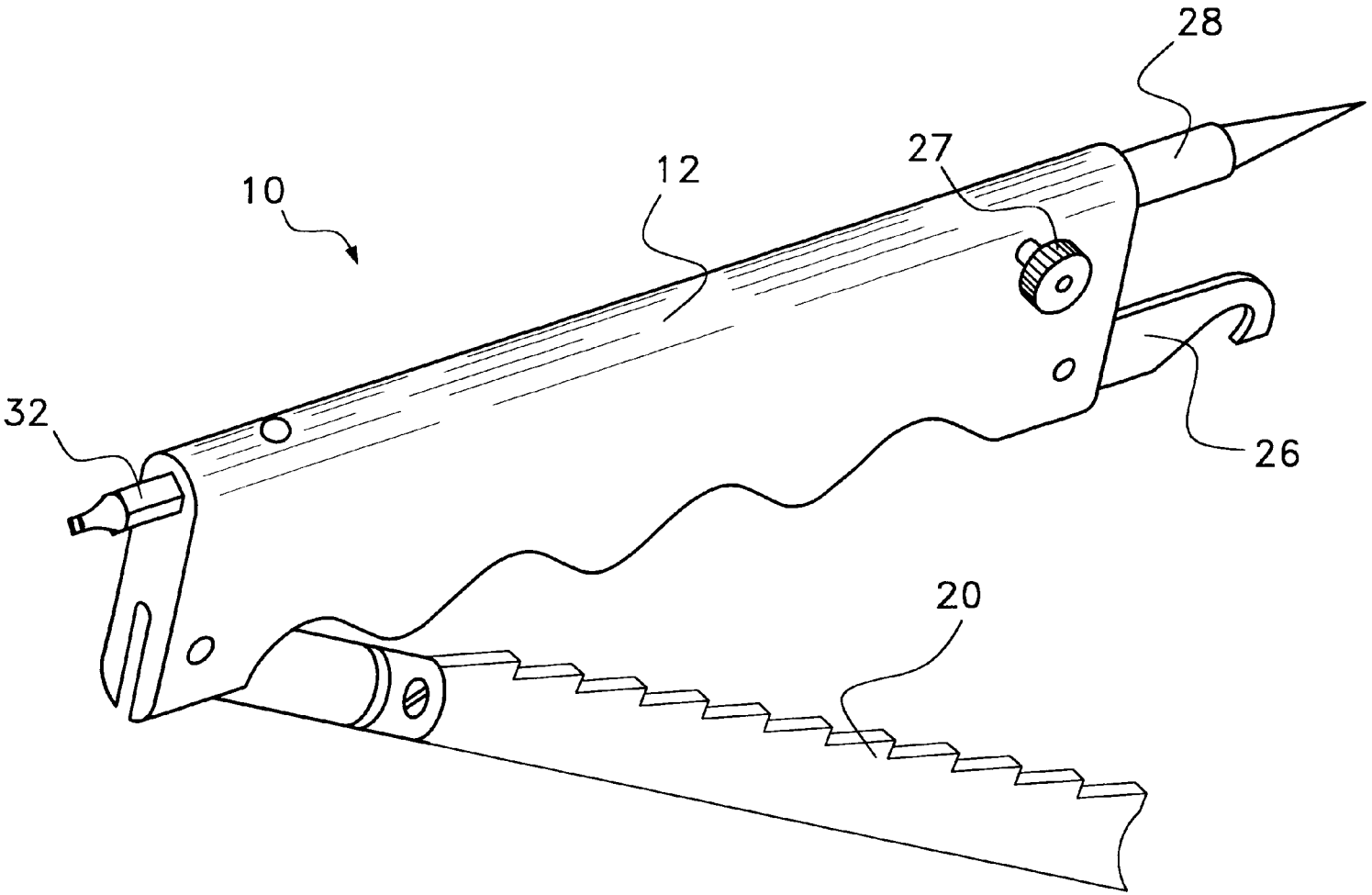
FIG. 1 is a perspective view of an exemplary embodiment of a rescue tool in accordance with the present invention.

Referring to FIG. 1, an exemplary embodiment of a multiple function rescue tool 10 is illustrated in accordance with the present invention. The rescue tool 10 is a hand-held tool that is used by emergency personnel during a rescue. The rescue tool 10 is comprised of a main handle body 12 that supports a variety of different tool elements.

Figure 2:
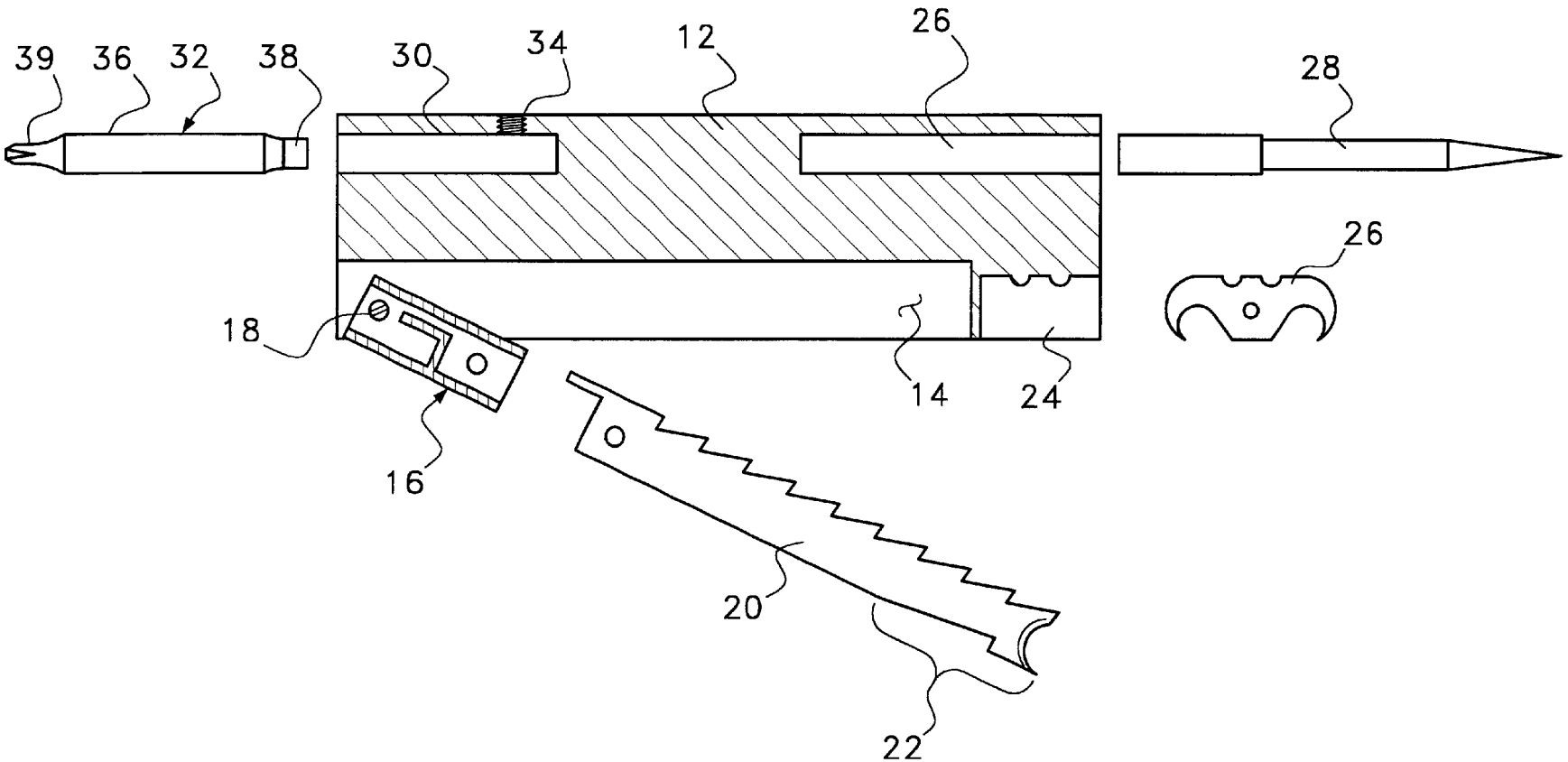
FIG. 2 is cross-sectional view of the embodiment of the rescue tool shown in FIG. 1.

Referring to FIG. 2, it can be seen that inside the main handle body 12 is a blade slot 14. A blade is connected to the handle body 12 and pivots into the blade slot 14 when retracted. The blade can be permanently coupled to the handle body. However, in the preferred embodiment, the blade is replaceable. To facilitate a replaceable blade, a blade coupling mechanism 16 is provided at one end of the blade slot 14. The blade coupling mechanism 16 is configured to engage most any commercially available reciprocal saw blade. The mounting configuration for reciprocal saw blades is standardized among the various manufacturers in the United States. In this manner the blades from one reciprocal saw manufacturer can be used on another manufacturer's saw and vice versa.

The blade coupling mechanism 16 is mounted to the main handle body 12 with a pivot 18. In this manner, when the blade coupling mechanism 16 engages a blade 20, the blade 20 can be selectively rotated in and out of the blade slot 14, like the blade of a pocket knife. Accordingly, the blade 20 can be selectively moved between a retracted position, where the blade 20 is in the blade slot 14, and an extended position, where the blade 20 protrudes from the main handle body 12.

The blade coupling mechanism 16 can engage any type of reciprocating saw blade that fits within the blade slot 14. As such, the rescue tool can be fitted with a blade designed to cut metal, wood, plastic or glass. In the shown embodiment, the blade 20 is designed to cut through fractured safety glass. Furthermore, the tip portion 22 of the blade 20 is configured into the shape of an door lock shim. The blade 20 can therefore be used to either cut fractured safety glass or shim open a lock on the door to a home or a building.

At the end of the main handle body 12, opposite the blade coupling mechanism 16, is a razor blade retaining slot 24. The razor blade retaining slot 24 is configured to retain standard, commercially available hooked razor blades 26. When a hooked razor blade 26 is placed within 5 the retaining slot 24, half of the hooked razor blade 26 protrudes from the main handle body 12. The protruding section of the hooked razor blade 26 can be used to cut a seat belt or any other non-metal obstruction during a rescue.

Above the razor blade retaining slot 24 is a blind bore 26. The blind bore 26 is sized to receive a commercially available spring-loaded center punch 28. Spring-loaded center punches 28 are available from a variety of manufacturers. In the majority of cases, spring-loaded center punches 28 are manufactured with a round cross-sectional profile that can be received within the blind bore 26. To lock the body of the spring-loaded center punch 28 at the proper position within the blind bore 26, a locking screw 27 (FIG. 1) is provided. The locking screw 27 engages the body of the center punch 28 in the blind bore 26 and holds it in place. Once locked in place by the locking screw 27, the pointed tip of the center punch 28 extends from the main handle body 12. The main handle body 12, thereby, effectively becomes the handle to the spring-loaded center punch 28.

A second blind bore 30 is disposed in the main handle body 12 on the side opposite the first blind bore 26. As such, the first blind bore 26 and the second blind bore 30 are separate but are concentrically aligned. A double headed tool element 32 is retained in the second blind bore 30. The double headed tool element 32 is retained within the second blind bore 30 by either friction, magnetism or a locking screw 34.

In an alternate embodiment, both the shaft of the double headed tool element 32 and the second blind bore 30 can be fabricated with a hexagonal cross-sectional profile. In such an embodiment, the double headed tool element would not be capable of rotating within the confines of the second blind bore.

At one end of the double headed tool element 32 is formed a hardened screw driver tip 38. At the opposite end of the double headed tool element 32 is formed a valve stem removal tip 39. When the double headed tool element 32 is placed in the second blind bore 30 so that the screw driver tip 38 extends from the main handle body 12, the double headed tool element 32 can be used as a screw driver, a pry bar or a dead lock turning mechanism.

When the double headed tool element 32 is placed in the second blind bore 30 so that the valve stem removal tip 39 extends from the main body, the double headed tool element 32 can be used to remove the valve stem valve from an inflated tire.

Often rescue workers are required to pry open doors to rescue people who are disabled in their homes. The existence of the double headed tool element 32 makes this task easier, by providing both a prying element and a means for turning a dead bolt, once the face of a dead bolt is removed from a locked door.

Furthermore, rescue workers are also commonly given the task of stabilizing a vehicle they find at an accident scene. To stabilize an automobile and prevent it from rolling, blocks are placed under the frame of the automobile. The wheels of the automobile are then deflated so that the frame of the automobile rests on the blocks. In the past, the tires of such vehicles have been punctured. However, the valve step removal tip 39 on the double headed tool element 32 enables the valves within a tire's valve stem to be removed. Tires can therefore be easily deflated without damage to the tires.

Referring back to FIG. 1, it will now be understood that the rescue tool is used in the following manner during a rescue at an automobile accident. If the doors to the automobile are rendered disabled by the accident, a rescuer uses the spring-loaded center punch 28 to shatter the automobile window closest the person trapped in the automobile. If the rescue is to be made through the safety glass of the windshield, shattering the safety glass is insufficient to remove the glass as an obstacle. Rather, safety glass is held together by clear plastic laminates. To remove the safety glass, the clear plastic laminates must be cut away.

To cut away the shattered safety glass, the saw blade 20 is extended from the rescue tool 10. The main handle body 12 is used to move the saw blade 20 through the safety glass and cut the plastic laminates. Once the safety glass is removed, the seat belt is cut using the hooked razor blade 26 that protrudes from the main handle body 12.

It will be understood that the embodiment of the present invention described and illustrated herein is merely exemplary and a person skilled in the art can make many variations to the embodiment shown without departing from the scope of the present invention. It should also be understood that the various elements can be oriented in different configurations to create alternate embodiments that are not specifically described. All such variations, modifications and alternate embodiments are intended to be included within the scope of the present invention as defined by the appended claims.

What is claimed is:

1. A rescue tool device, comprising:

a handle body having
- a first end and a second end;
- a first blind bore disposed in said first end;
- a second blind bore disposed in said second end
- a blade slot disposed between said first end and said second end and;
- a razor blade retaining slot;

a serrated blade having one end coupled to said handle body, said blade being selectively positionable between an extended position, where said serrated blade extends away from said handle body, and a retracted position, where said serrated blade is at least partially disposed within said blade slot;

a hooked razor blade coupled to said handle body within said razor blade retaining slot;

a removable spring-loaded center punch received within said first blind bore of said handle body, wherein at least part of said spring-loaded center punch extends from said first blind bore when said spring-loaded center punch is placed within said first blind bore; and a removable double headed tool element received within said second blind bore in one of two orientations, wherein one head of said double headed tool element extends from said second blind bore when said double headed tool element is placed within said second blind bore.

2. The device according to claim 1, wherein said spring-loaded center punch is a separate tool element that can be selectively removed from said handle body.

3.The device according to claim 1, further including a locking screw that extends into said first blind bore for locking said spring-loaded center punch into said first blind bore.

4. The device according to claim 1, wherein said serrated blade is coupled to said handle body with a pivot, wherein said serrated blade is selectively positionable between said retracted position and said extended position about said pivot.

5. The device according to claim 1, further including a blade coupling mechanism coupled to said handle body with a pivot, wherein said blade coupling mechanism is configured to selectively receive and retain said serrate blade and guide said serrated blade between said extended position and said retracted position.

6. The device according to claim 5, wherein said serrated blade is a reciprocating saw blade.

7. The device according to claim 1, wherein said serrated blade has a tip and said serrated blade is configured as a door lock shim proximate said tip.

8. The device according to claim 1, wherein said double headed tool element terminates at one end with a screw driver head.

* * * * *